US005684921A

United States Patent [19]

Bayya et al.

[11] Patent Number: 5,684,921

[45] Date of Patent: Nov. 4, 1997

[54] METHOD AND SYSTEM FOR IDENTIFYING A CORRUPTED SPEECH MESSAGE SIGNAL

[75] Inventors: Aruna Bayya, Louisville; Louis A. Cox, Jr., Denver; Marvin L. Vis, Boulder, all of Colo.

[73] Assignee: U S West Technologies, Inc., Boulder, Colo.

[21] Appl. No.: 501,852

[22] Filed: Jul. 13, 1995

[51] Int. Cl.[6] ..... G10L 9/18

[52] U.S. Cl. ..... 395/2.35; 395/2.23; 395/2.1; 395/2.19; 395/2.35; 395/2.36; 395/2.37; 379/88

[58] Field of Search ..... 395/2.1, 2.17, 395/2.19, 2.15, 2.23, 2.24, 2.35–2.37, 2.42, 2.43; 379/88

[56] References Cited

U.S. PATENT DOCUMENTS

| | | | |
|---|---|---|---|
| 4,016,540 | 4/1977 | Hyatt | 395/2.67 |
| 5,341,457 | 8/1994 | Hall, II et al. | 395/2.35 |
| 5,490,204 | 2/1996 | Gulledge | 379/59 |
| 5,553,193 | 9/1996 | Akagiri | 395/2.38 |

OTHER PUBLICATIONS

Deller, Jr. et al., Discrete–Time Processing of Speech Signals, Prentice Hall, p. 39. 1993.

*Primary Examiner*—Allen R. MacDonald
*Assistant Examiner*—Alphonso A. Collins
*Attorney, Agent, or Firm*—Brooks & Kushman, P.C.

[57] ABSTRACT

A method is disclosed for identifying corrupted speech signals in a call receiving mode of a voice messaging system. The method includes the step of receiving a message signal. The message signal represents an audio message. The method next includes the step of determining a signal quality. The signal quality is then compared to a threshold. If the signal quality is at least as great as the threshold, the audio data representing the message signal is stored in a memory. If the signal quality is not as great as the threshold, an indication signal is transmitted indicating that the signal quality is poor. A system is also disclosed for implementing the steps of the method.

14 Claims, 16 Drawing Sheets

METHOD AND SYSTEM FOR IDENTIFYING A CORRUPTED SPEECH MESSAGE SIGNAL

TECHNICAL FIELD

This invention relates generally to methods and systems for identifying corrupted speech signals. Specifically, the invention relates to methods and systems for identifying voice messages based on corrupted speech signals originating from a cordless or cellular telephone.

BACKGROUND ART

Recently, the use of alternative telecommunication services has increased significantly. Such alternative telecommunication services include automated voice messaging, cellular and other cordless telephone service.

Although the quality of cellular and other cordless telephone service is improving, a number of factors cause channel conditions to vary in quality. In many instances, channel conditions can be poor. When channel conditions are poor and background or channel noise is high, a speech signal may be masked by the noise. If there is a great enough disparity between the original clean signal and the noisy signal, the speech signal may be corrupted to the extent that the speech message is unintelligible.

During a telephone conversation between two telephone users, a corrupted speech signal can be annoying to the user receiving the message. The receiving user can often remedy this situation by requesting that the message sender repeat the message. Alternatively, the message receiver may request that the sender terminate and reestablish the connection to obtain improved channel conditions.

The problem of a corrupted speech signal is even more significant during a telephone call between a cellular telephone user and an automated voice message system. When the cellular user is sending a message to be stored in a voice mail box of a message receiver, poor channel conditions can render the message unintelligible. In such an instance, the cellular user has no way to efficiently ensure the quality of the received message signal.

Even if the automated voice message system provides the capability to replay messages prior to storage, poor channel conditions occurring while the message is being replayed may cause the cellular user to mistakenly believe that the message is unintelligible when, in fact, it is not.

DISCLOSURE OF THE INVENTION

A need exists for a method and system for providing feedback to the sender regarding the quality of a speech signal. The present invention described and disclosed herein comprises a method and system for identifying a corrupted speech signal.

It is an object of the present invention to provide a method and system for determining if a speech signal is corrupted to the extent that it is at least partially unintelligible.

It is another object of the present invention to provide a method and system for providing feedback to a message sender regarding the quality of the speech signal used as a message in an automated voice messaging system.

It is yet another object of the present invention to provide a method and system for employing noise suppression techniques to improve the quality of stored audio messages received and recorded over noisy cellular channels.

In carrying out the above objects and other objects of the present invention, a method is provided for identifying a corrupted speech signal.

The method is for identifying corrupted message signals in a call receiving mode of a voice messaging system. The method begins with the step of receiving a message signal representing an audio message.

Next, the method includes the step of determining a signal quality. The signal quality is then compared to a threshold to determine if the signal quality is corrupted to the point of rendering the audio message unintelligible. If, based on the signal quality, the audio message is intelligible, audio data is stored. The stored audio data represents the audio message.

If, based on the signal quality, the audio message is unintelligible, an indication signal is transmitted to the user. The indication signal indicates that the signal quality is poor.

In further carrying out the above objects and other objects of the present invention, a system is also provided for carrying out the steps of the above described method.

The objects, features and advantages of the present invention are readily apparent from the detailed description of the best mode for carrying out the invention when taken in connection with the accompanying drawings.

BRIEF DESCRIPTION OF THE DRAWINGS

A more complete appreciation of the invention and many of the attendant advantages thereof may be readily obtained by reference to the following detailed description when considered with the accompanying drawings in which reference characters indicate corresponding parts in all of the views, wherein:

FIGS. 3*a*–3*d* are graphs of speech signals of varying noise levels;

FIGS. 4*a*–4*d* are graphs of signal/noise ratios (SNR) for the speech signals of FIGS. 3*a*–3*d;*

FIGS. 5*a*–5*d* are graphs of spectral flatness measure (SFM) estimates for the speech signals of FIGS. 3*a*–3*d;*

BEST MODES FOR CARRYING OUT THE INVENTION

The enhanced voice messaging system of the present invention includes two components. The first is a preprocessing component that measures the level of noise in a transmitted signal in a call receiving mode. This component allows the system to indicate to the caller that the message being recorded is unintelligible if the received signal is excessively noisy.

The second component is an off-line post-processing component that enhances the quality of a stored audio message. Although this component can be used prior to storing the audio data representing the message, it is preferably used in a message retrieval mode. When an audio message is being retrieved, noise suppression techniques are employed to enhance the signal quality and provide a more intelligible message to the user.

A software-based prototype system has been developed on a Unix platform, specifically on Sun Sparc 20. The telephone interface used in the prototype system is an equipment DeskLab manufactured by Gradient Technologies.

Figure 1:
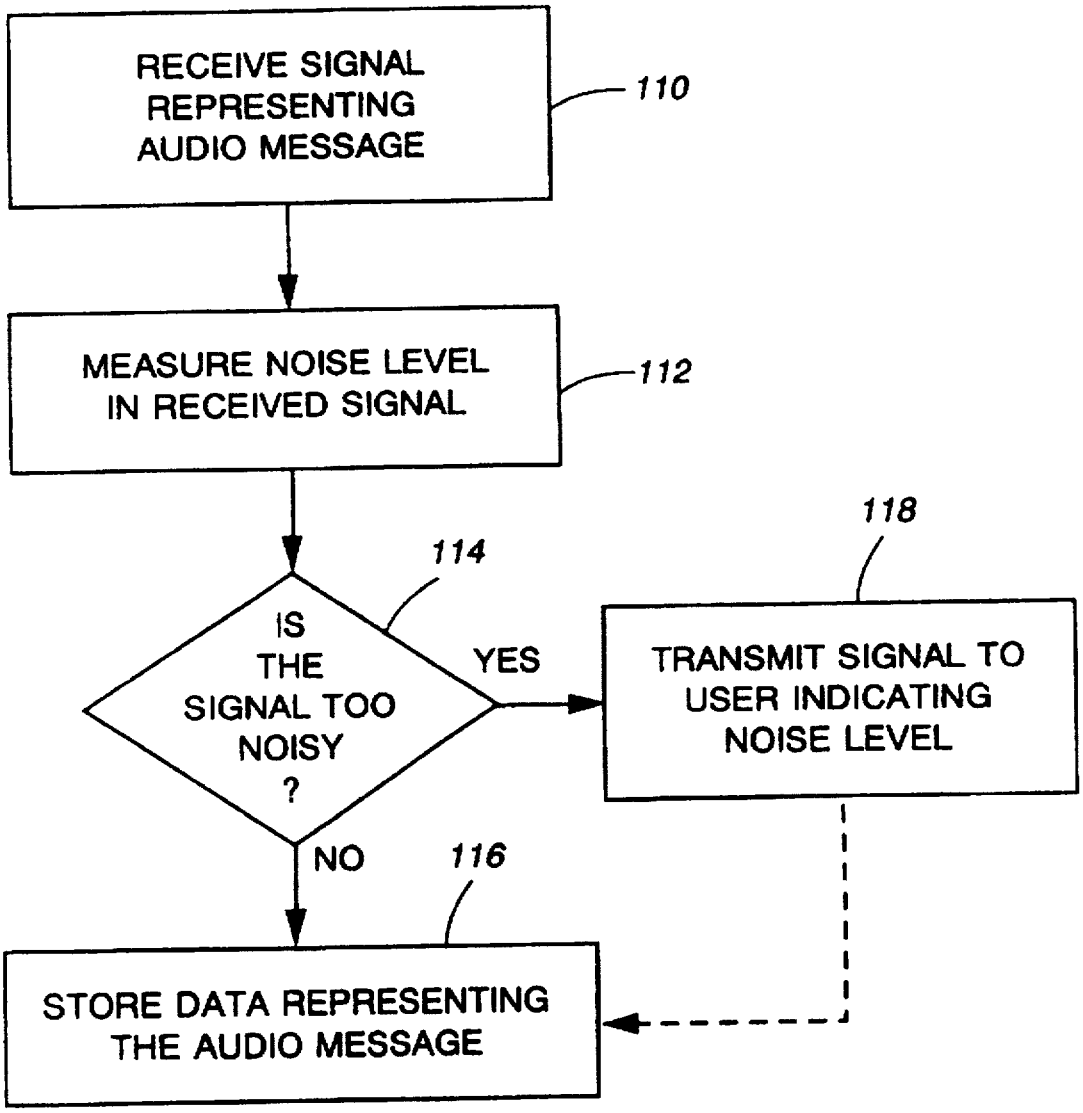
FIG. 1 is a flow chart illustrating the steps of the call receiving mode of the present invention.

Referring now to FIG. 1 of the drawing figures, there is illustrated, in block diagram format, the steps describing a typical use of the present invention in the call receiving mode. In the call receiving mode, the system accepts calls and records messages from cellular phones. At the end of recording, if the message is too noisy, the system informs the caller of the quality of the signal recorded.

The first step of the preferred method, shown by block 110 is receiving a signal. The signal represents an audio message generated by a user.

Block 112 illustrates that upon receiving the signal, the method next includes measuring the noise level in the received signal. The noise level can be measured using any one of a variety of techniques. The preferred techniques are described below in reference to FIGS. 3a–7.

At block 114, the method determines if the received signal is too noisy. If the noise level is within an acceptable range, block 116 shows that data representing the audio message is stored in the memory. If the received signal is too noisy, however, a signal is transmitted to the user indicating that the noise level is excessive.

Figure 2:
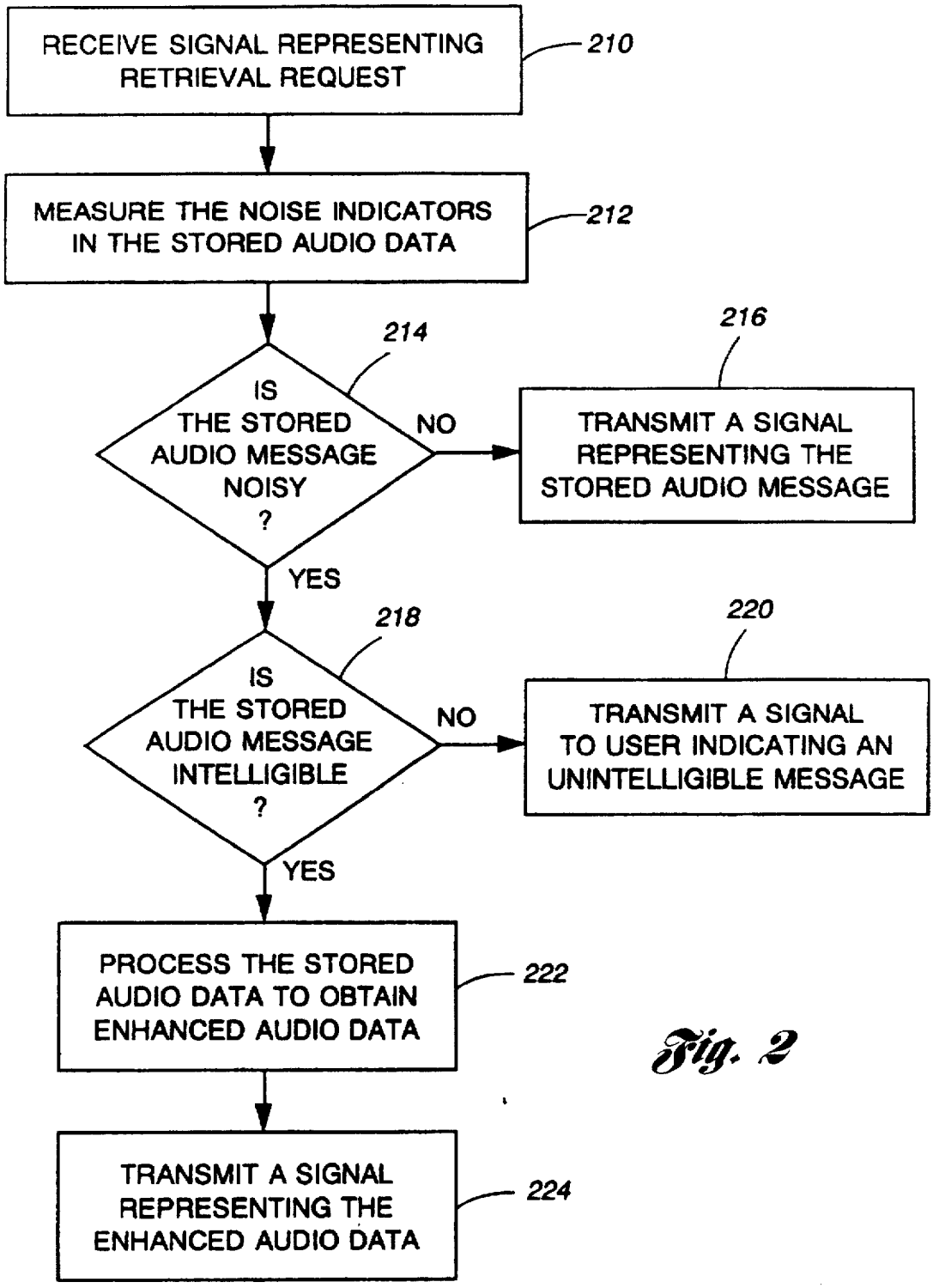
FIG. 2 is a flow chart illustrating the steps of the message retrieval mode of the present invention.

Referring now to FIG. 2, there is illustrated, in block diagram format, the steps describing a typical use of the present invention in the message retrieval mode. First, a signal representing a retrieval request is received as shown by block 210. Next, as shown by block 212, the method includes the step of measuring the noise indicators in the stored audio data.

Block 214 describes the step of determining if the stored audio message is noisy based on the measured noise indicators. If the stored audio message is not noisy, block 216 is processed and a signal representing the stored audio message is transmitted to the user.

If the message is noisy, block 218 is processed. Block 218 describes the step of determining if the stored audio message is intelligible. If the stored audio message is not intelligible, block 220 is processed and a signal is transmitted to the user. The signal indicates that the stored audio message is unintelligible.

If the stored audio message is noisy but intelligible, blocks 222 and 224 are processed. Block 222 describes the step of processing the stored audio data to obtain enhanced audio data. Block 224 describes the step of transmitting a signal representing the enhanced audio data.

Noise Level Estimation

Referring now to FIGS. 3a–3d, there is illustrated four graphs of speech signals of varying noise levels. FIGS. 3a–3d illustrate speech signals which are generally categorized as clean, slightly noisy, noisy and very noisy, respectively.

Figure 3A:
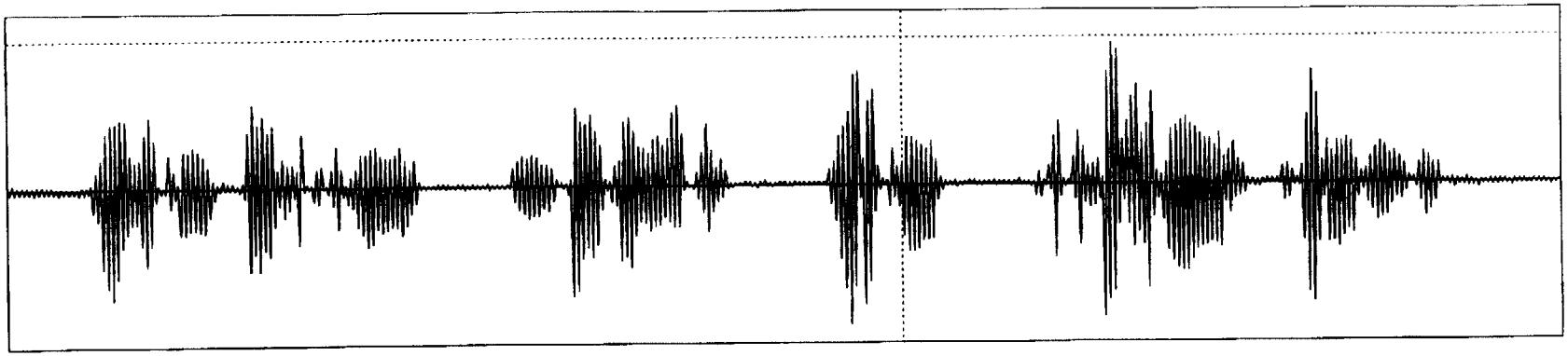
Figure 3B:
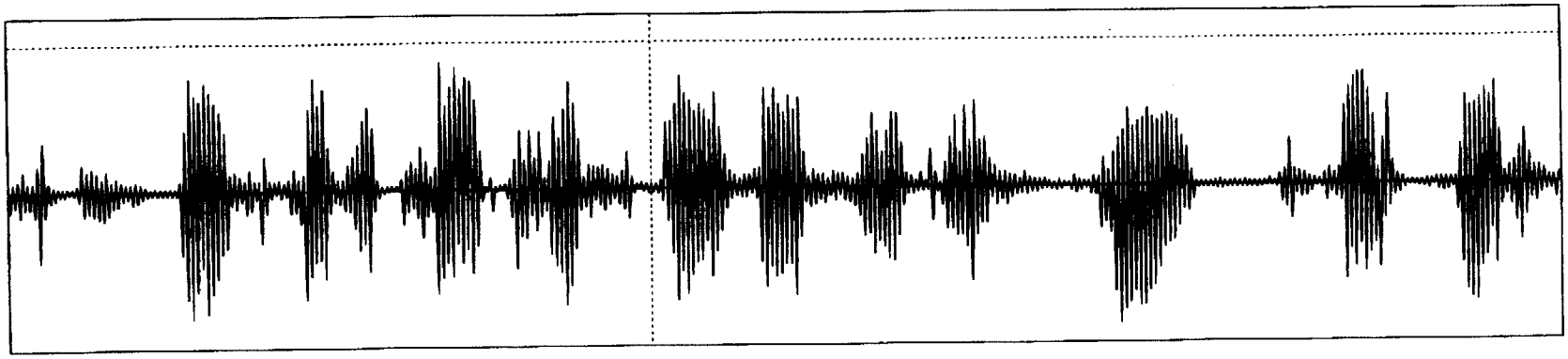
Figure 3C:
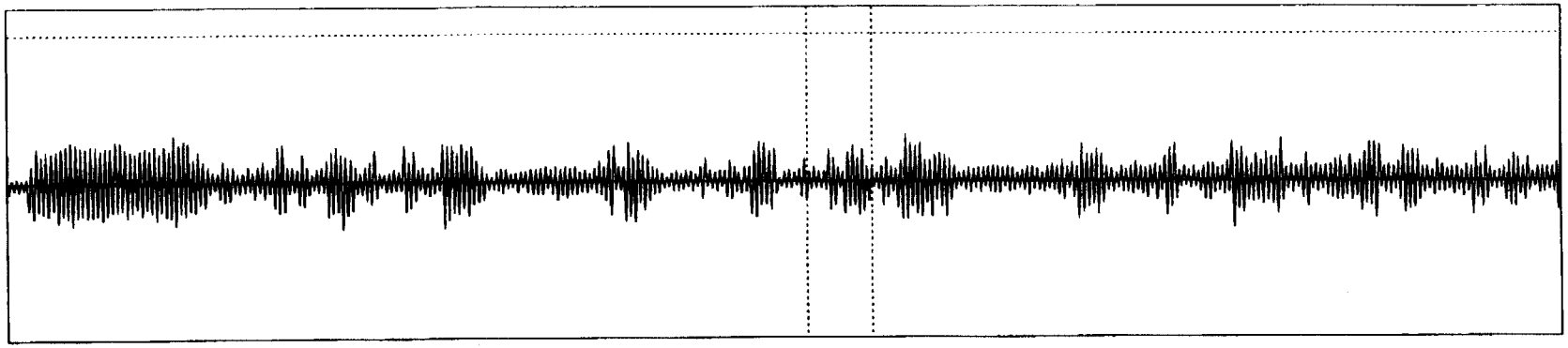
Figure 3B:
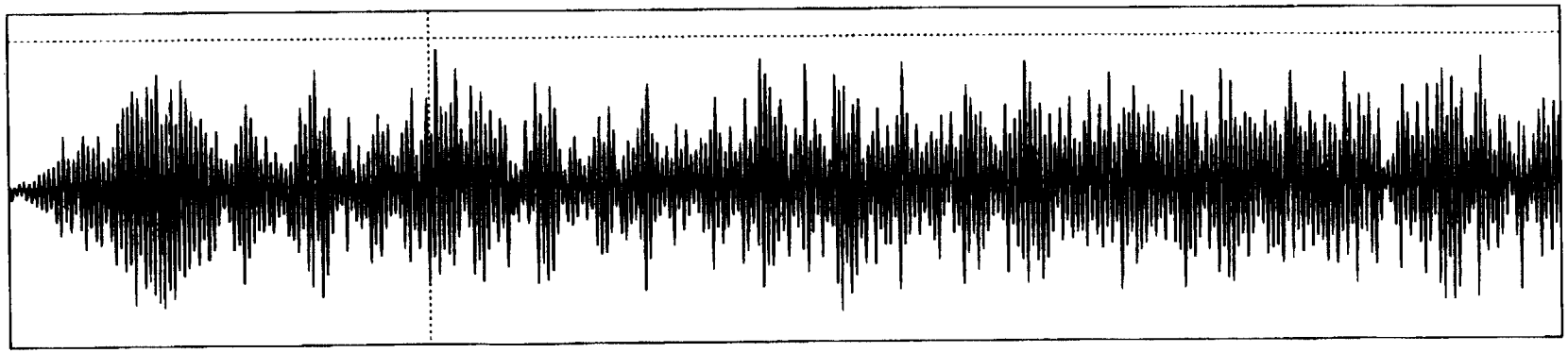
Figure 4A:
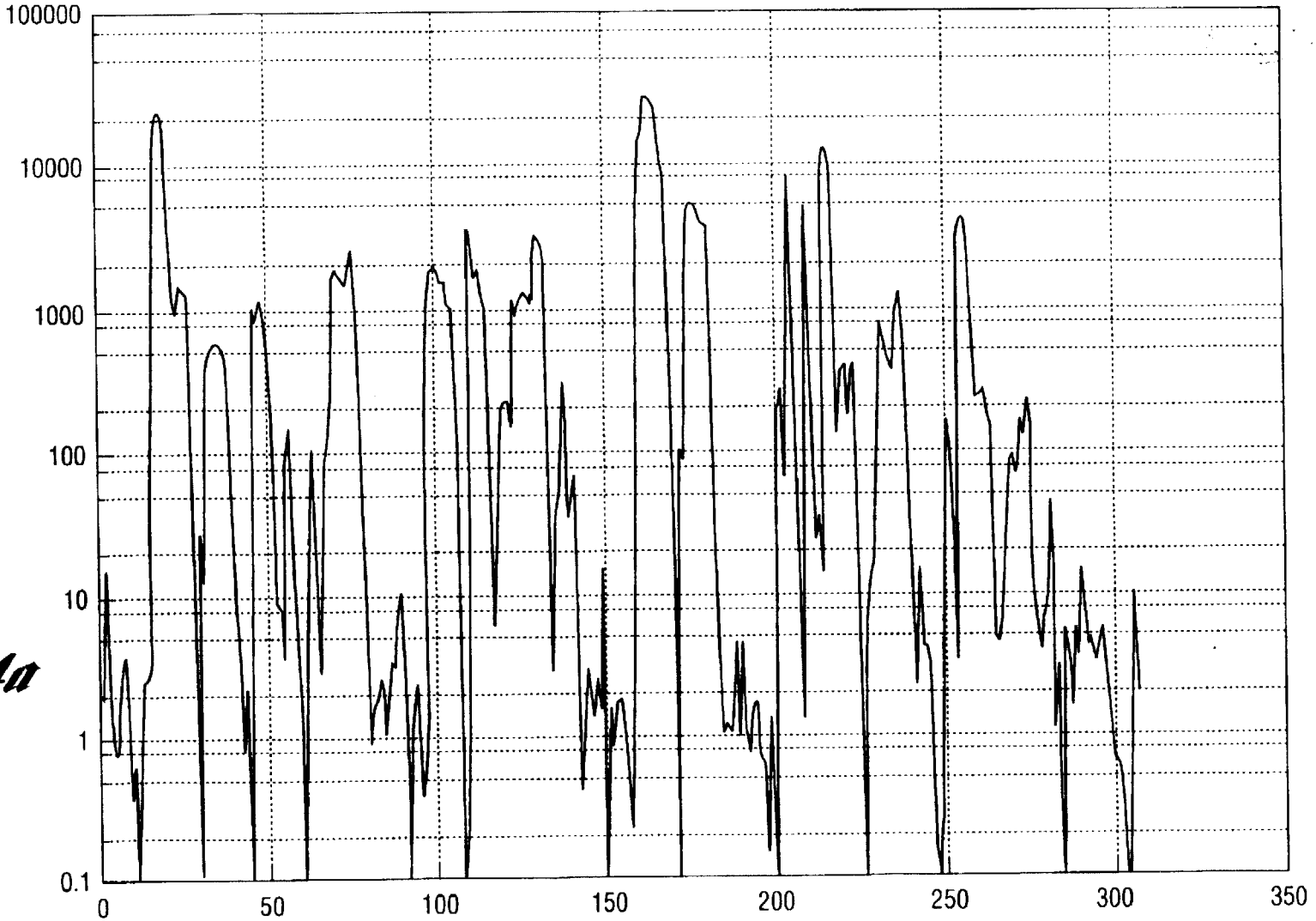
Figure 4B:
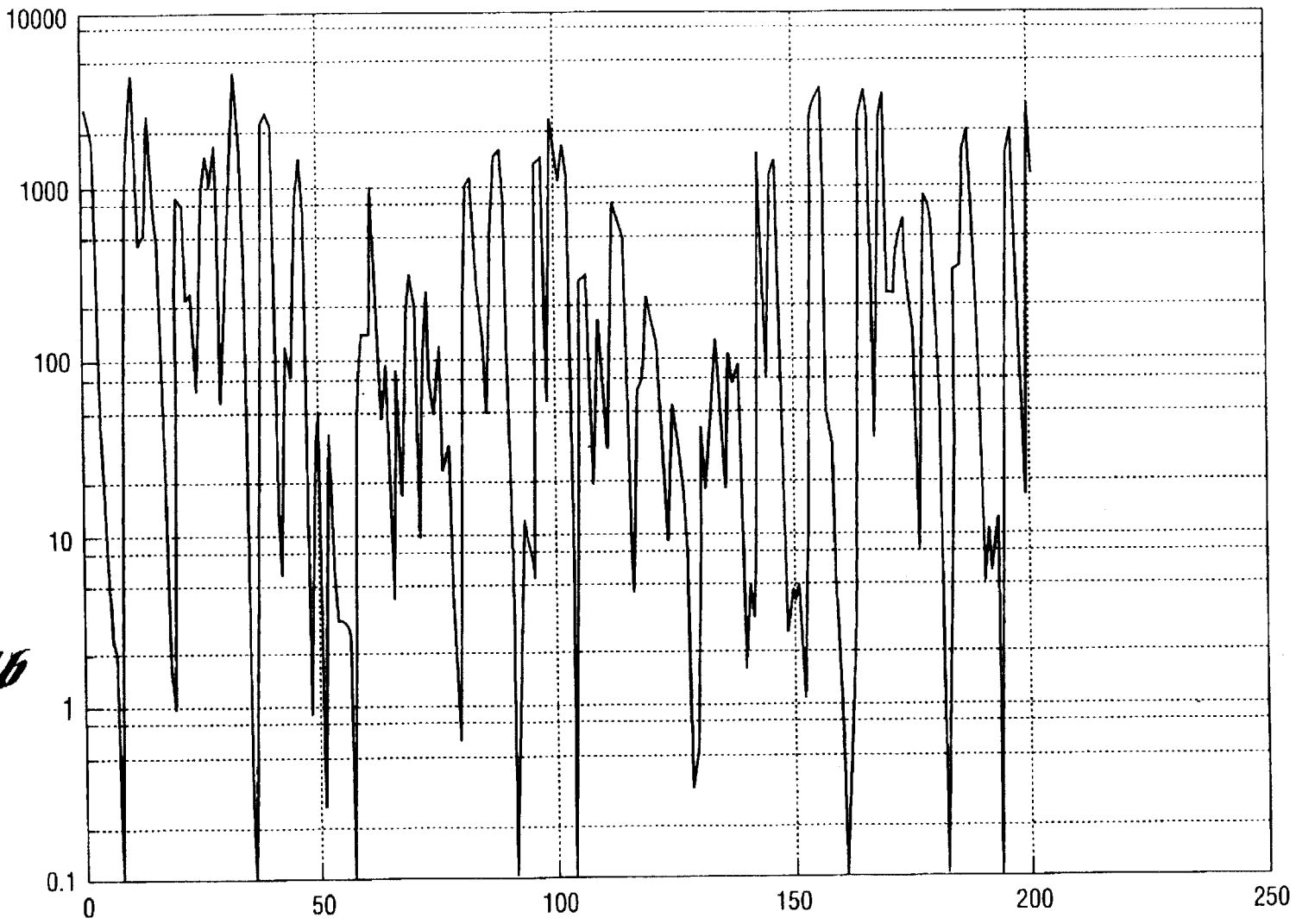
Figure 4C:
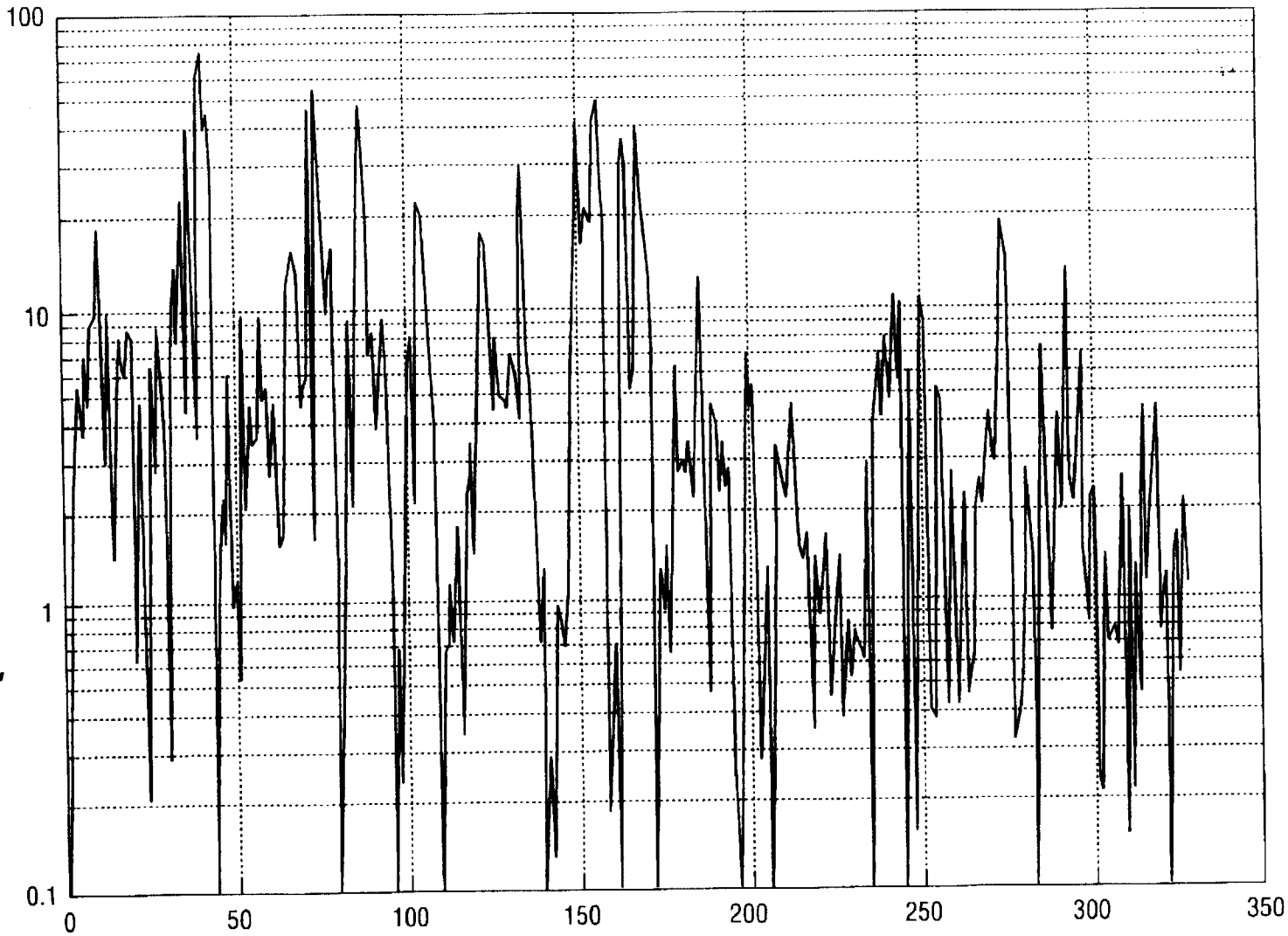
Figure 4B:
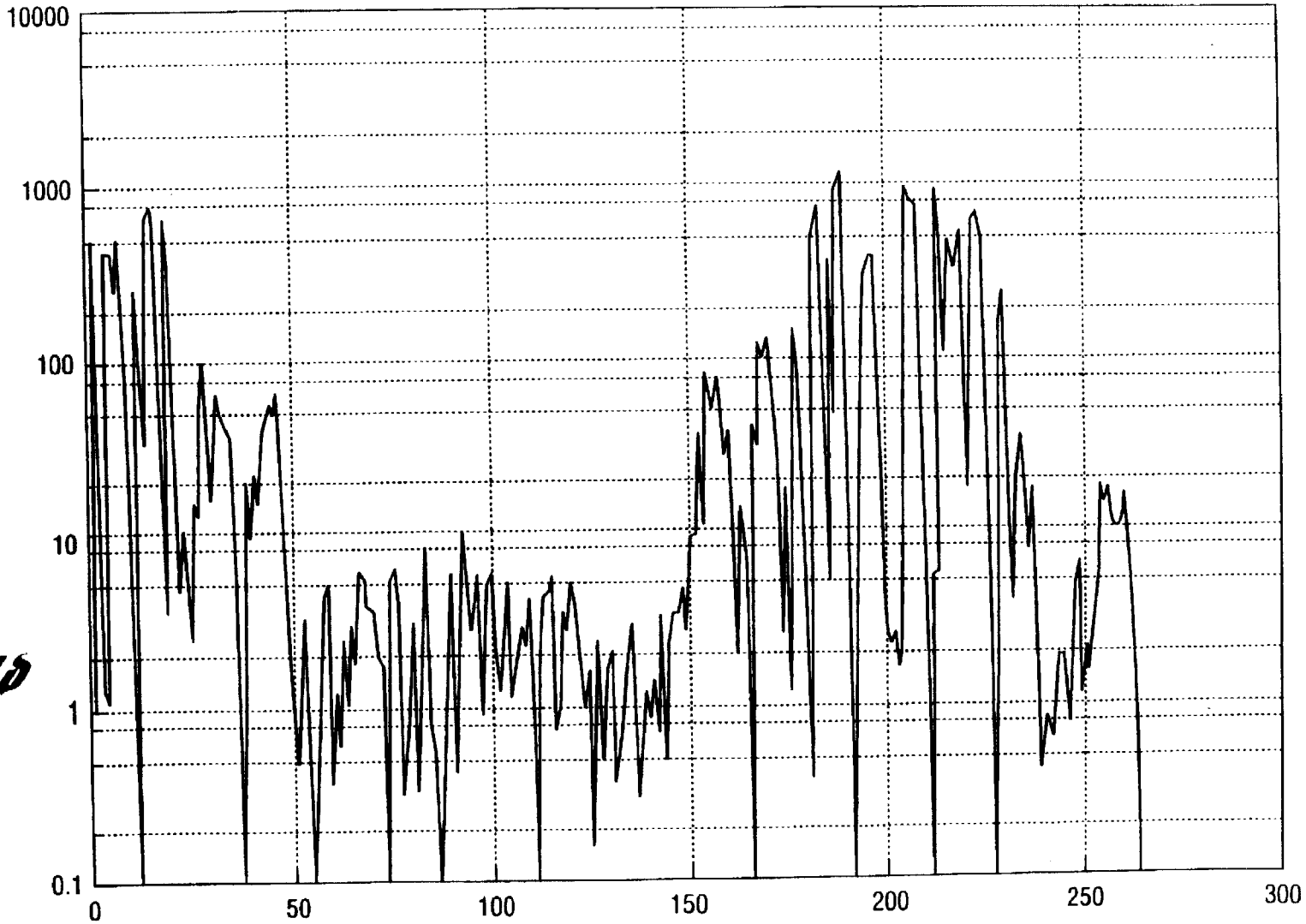
Figure 5A:
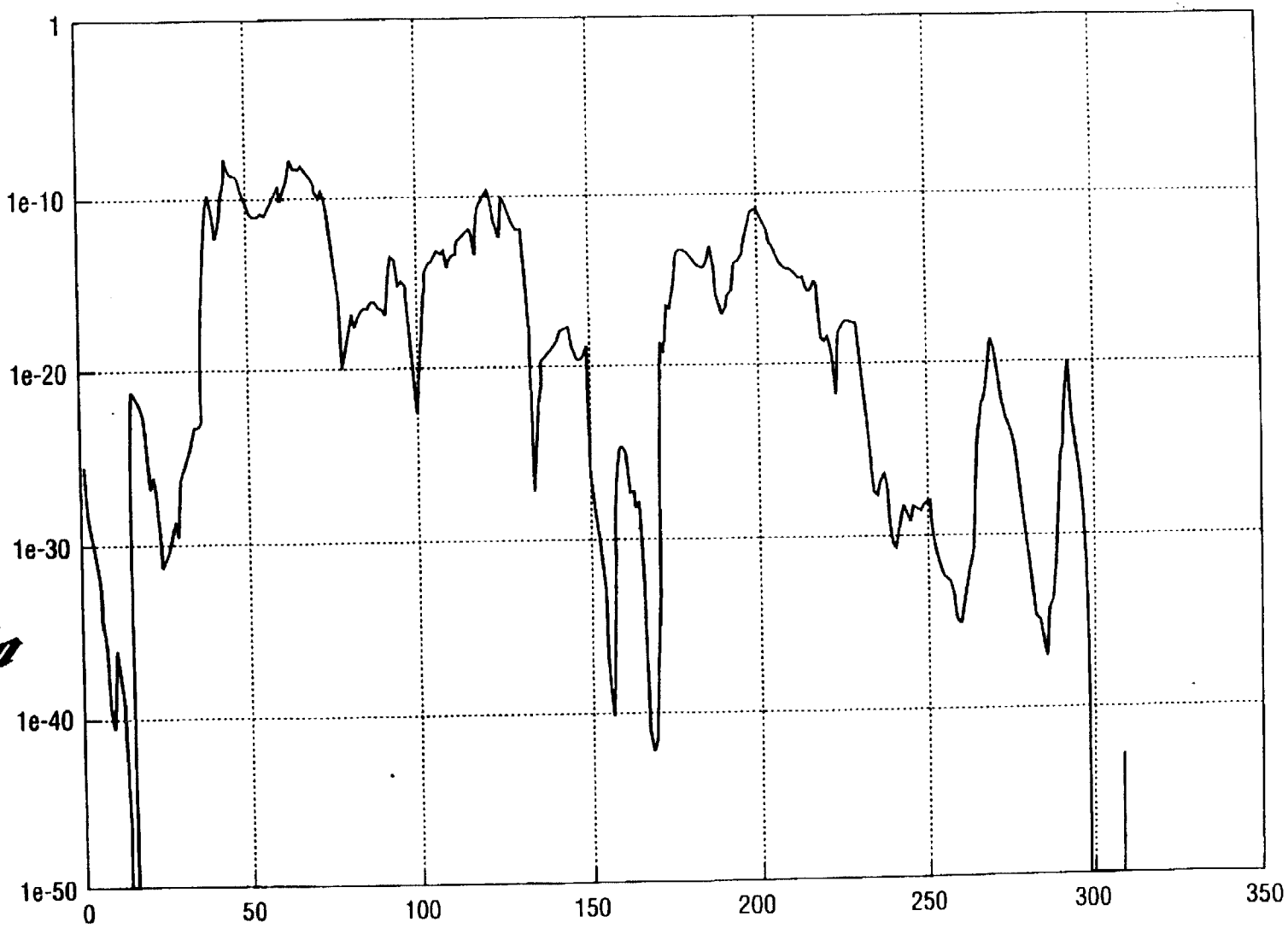
Figure 5B:
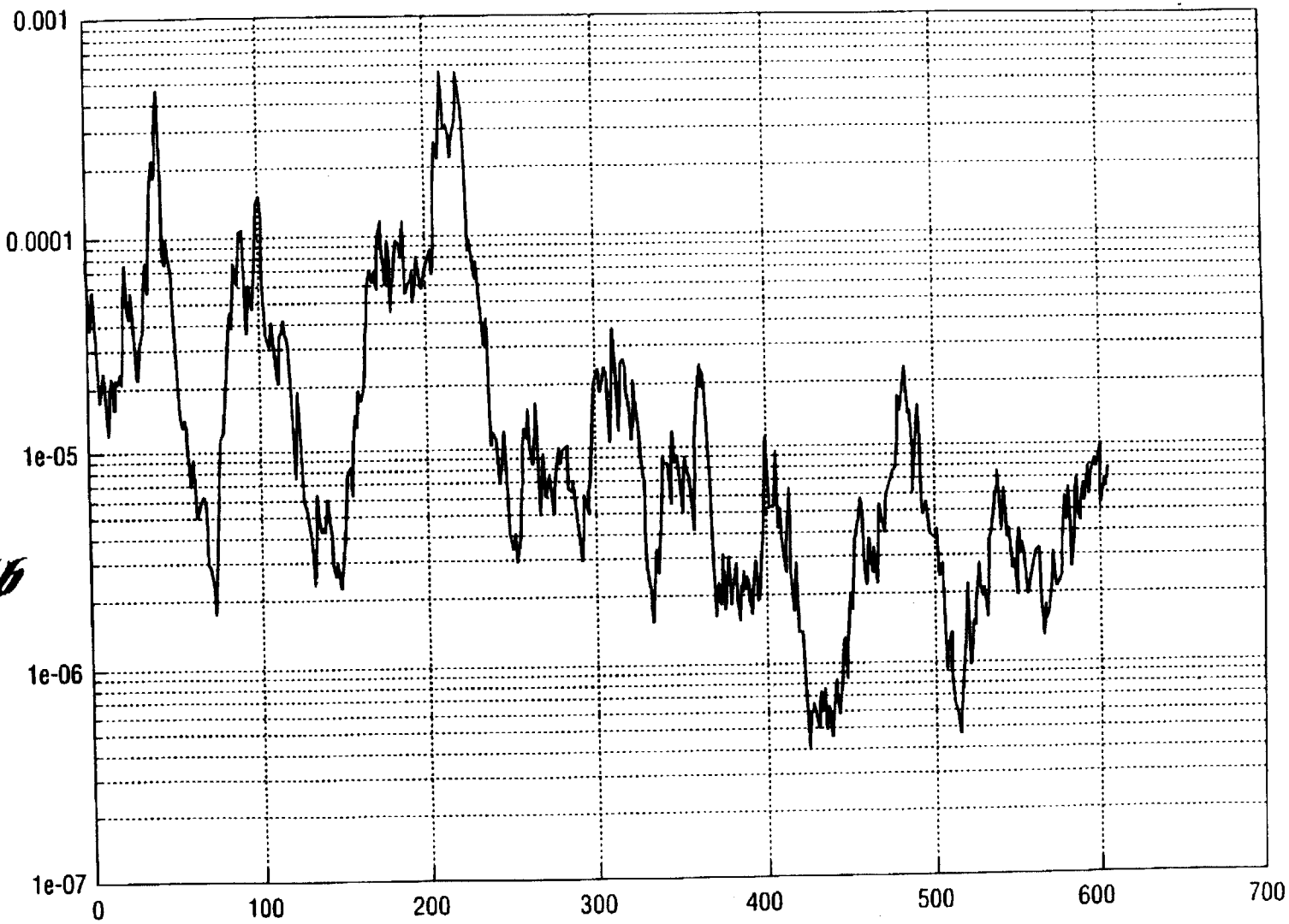
Figure 5C:
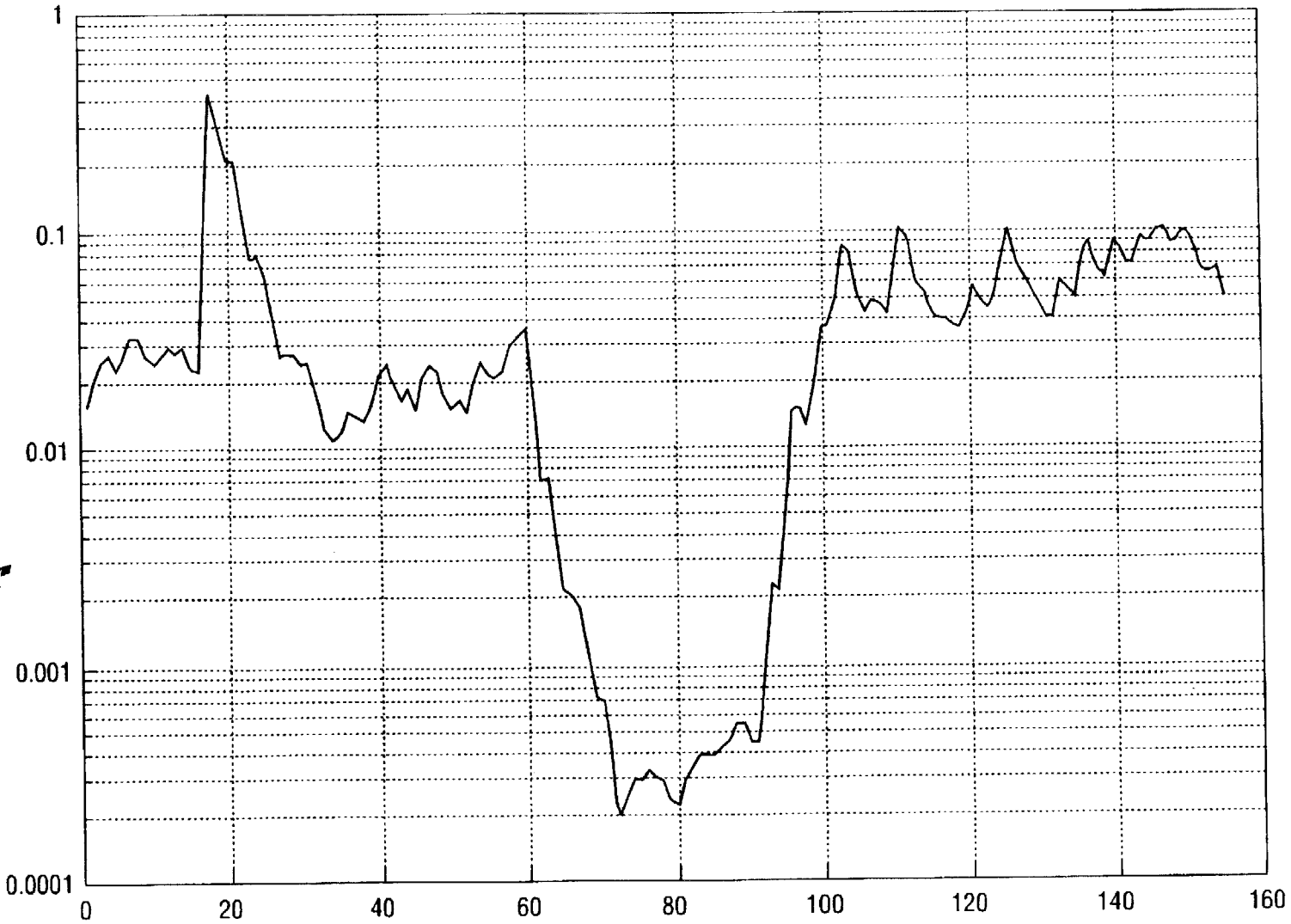
Figure 5B:
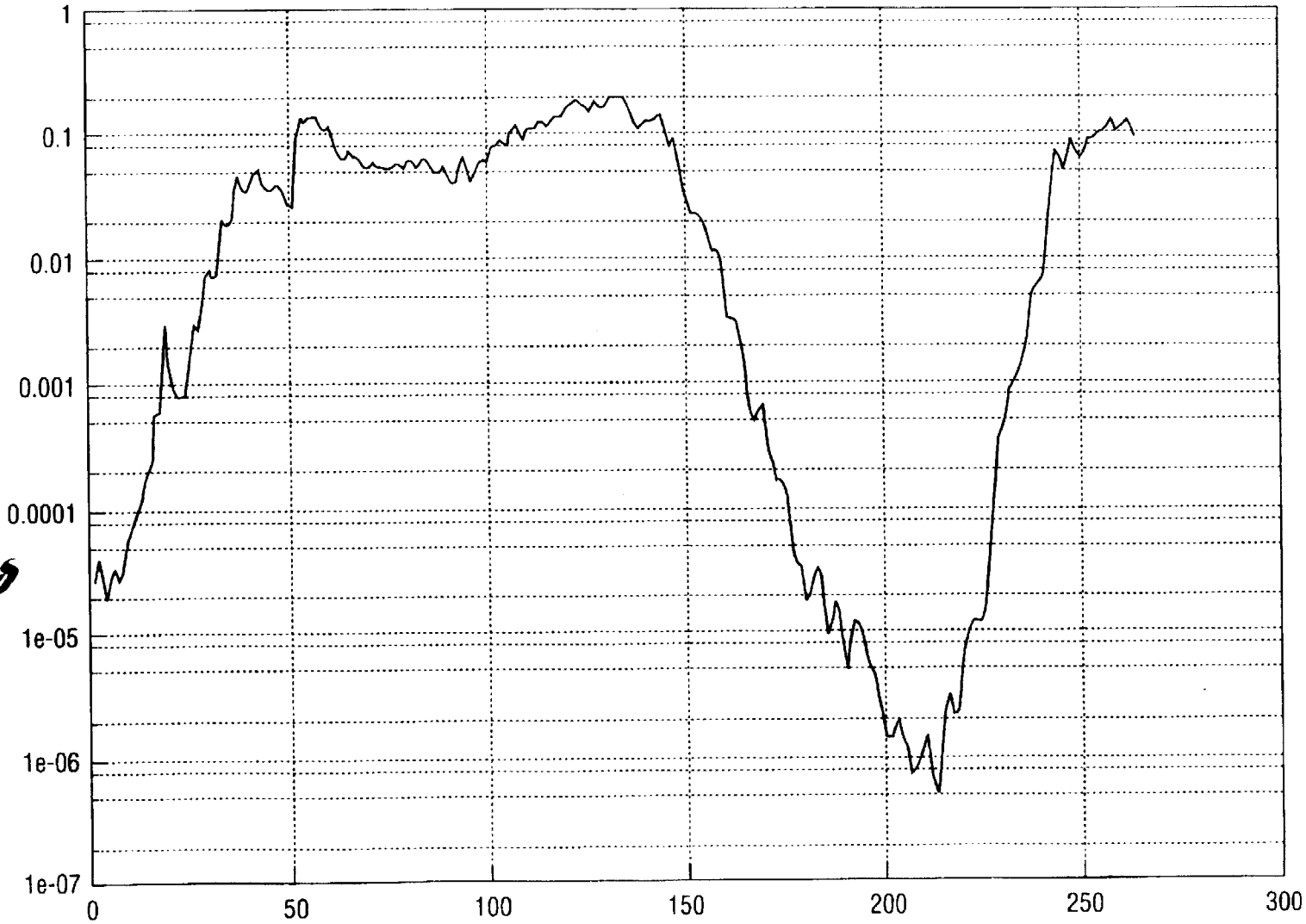

FIG. 3a illustrates a speech signal which includes a negligible amount of noise. FIG. 3b illustrates a speech signal containing a noticeable amount of noise. FIG. 3c illustrates a speech signal which is noisy but intelligible. Finally, FIG. 3d illustrates a speech signal which is so noisy that the speech signal is unintelligible. These speech signals will be used to illustrate the preferred embodiment of the present invention.

Noise level estimation is a difficult task especially when the source of noise is dynamic in nature. Several measures mostly variations of Signal-to-Noise Ratio ("SNR") have been proposed in the past. SNR is defined in the time domain as ratio of signal variance to noise variance and in the spectral domain as the ratio of logarithm of signal power to noise power.

SNR, though easier to compute, is not very reliable in distinguishing the noisy and unintelligible speech samples. Moreover, these SNR measures are representative of the level of noise only if the noise is additive. The preferred embodiment of the present invention utilizes several other measures that aid in classifying the recorded signal into clean, noisy and very noisy categories.

The recorded signal $x_i$ is defined as:

$$x_i = s_i + n_i$$

Referring now to FIGS. 4a–4d, there is illustrated graphs of instantaneous SNR for varying noise levels. $SNR_i$ is the estimated signal-to-noise ratio of $x_i$ at time i and is defined as:

$$SNR_i = 10 * \log_{10} \left\{ \frac{\overline{P}_i^x - \min(\text{ofactor} * P_i^n, \overline{P}_i^x)}{\text{ofactor} * P_i^n} \right\}$$

where $\overline{P}_i^x$ is the smoothed short-time power spectrum estimate at time i, $P_i^x$ is estimated minimum noise power and ofactor is a factor between 1 and 2 that accounts for the fact that minimum power estimate is smaller than true noise power. The higher the SNR is an indication of low noise level, in other words a cleaner signal. The SNR for speech signals of different quality is computed using Martin's technique.

Referring now to FIGS. 5a–5d, there is illustrated a modified spectral flatness measure. The unmodified spectral flatness measure is an indication of how close a signal is to being white noise and is defined as the ratio prediction variance, $\sigma^2$ to the variance of the signal $r_0$:

$$\xi = \frac{\sigma^2}{r_0} \frac{\exp\left\{ \int_{-\pi}^{\pi} \log S(e^{j\theta}) \frac{d\theta}{2\pi} \right\}}{\int_{-\pi}^{\pi} S(e^{j\theta}) \frac{d\theta}{2\pi}}$$

A smaller (<<1) value of spectral flatness measure is an indication of low noise level. The spectral flatness measure is modified in the present invention by normalizing the prediction error variance estimate of each block of speech by the ∞-norm square of the four nearest blocks of speech.

Figure 6:
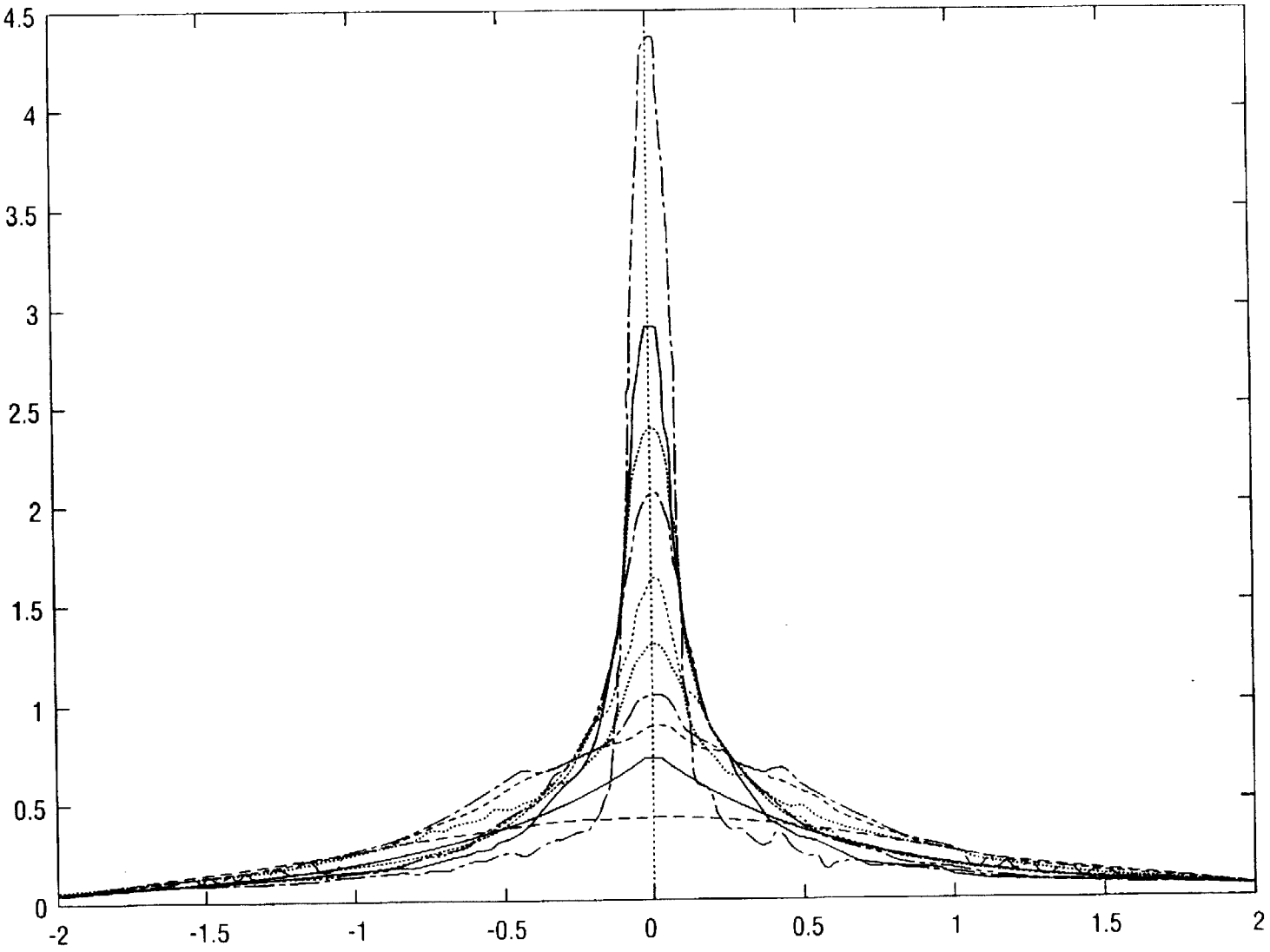
FIG. 6 is a graph of sample distributions for the signals of FIGS. 3*a*–3*d;*

Referring now to FIG. 6, there is illustrated a sample distribution for signals of varying noise levels. The sample distribution is a distribution of speech sample amplitudes and is an indication of the level of noise. The spread of the distribution function is directly proportional to the noise level. A narrow distribution indicates that the signal is less corrupted by the noise.

An energy histogram is another measure that can be used to determine the level of the noise in the recorded signal. An energy histogram of a speech signal is typically bi-modal. The higher first peak is an indication of higher level noise in the recorded signal.

Figure 7:
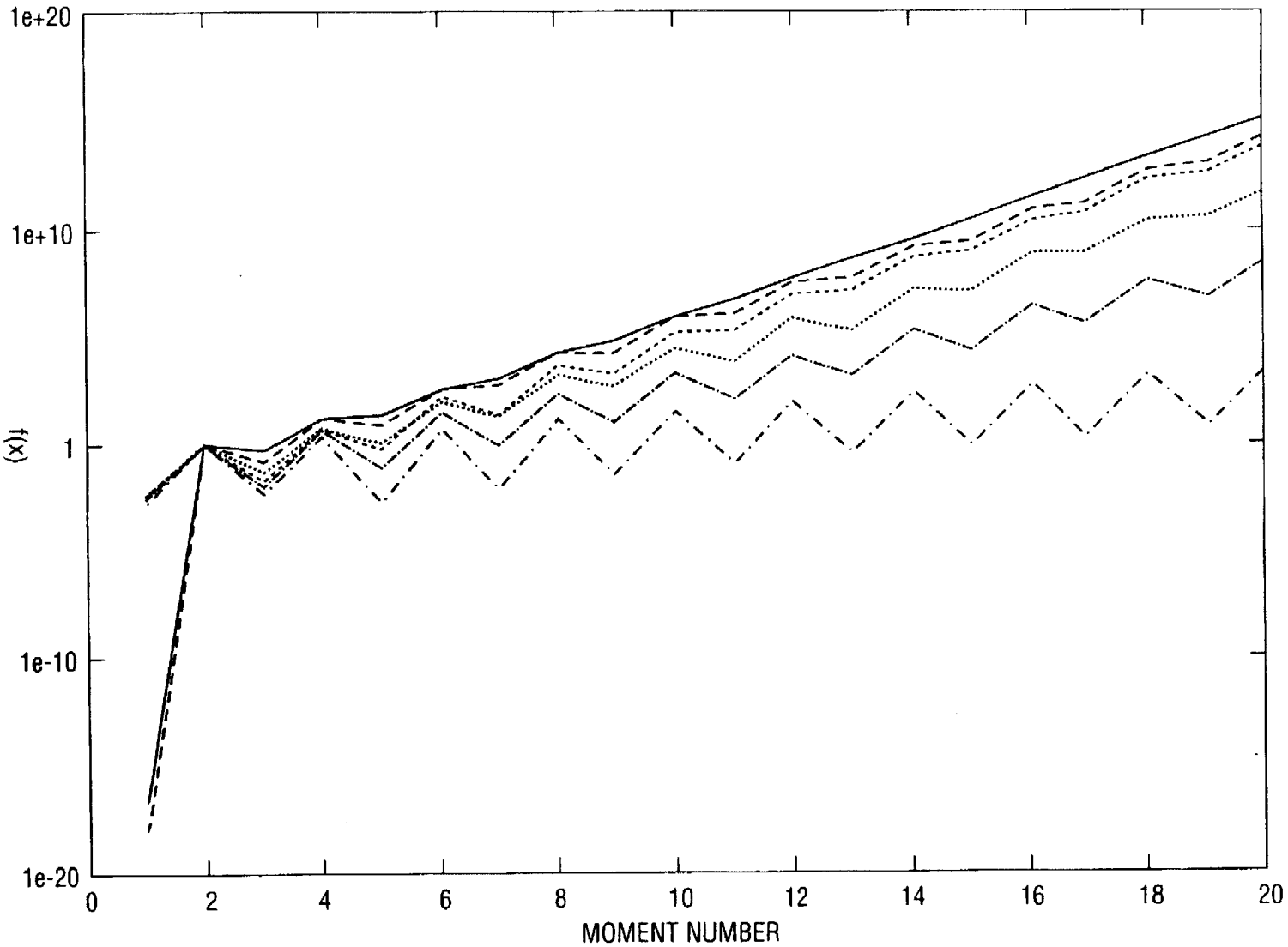
FIG. 7 is a graph of moments for the signals of FIGS. 3*a*–3*d;*

Referring now to FIG. 7, there is illustrated a graph of moments for signals of varying noise levels. Higher-order statistics such as second and third moments are used to classify the measured signal into various categories based on noise content. Higher values of the moments are the result of noisy speech. The kth moment of signal $x_i$ is defined as:

$$\hat{m}_k = \frac{1}{N} \sum_{i=0}^{N-1} x_i^k$$

These measures are computed for speech samples ranging in quality from clean to very noisy. From these values, thresholds are set for each of these measures. The criteria for categorization of signals is determined by a combination of these measures. The classification of a new message into clean, slightly noisy, noisy, and very noisy categories is performed by comparing each one of the measures against the corresponding threshold values.

Although these thresholds may be adjusted based on a specific implementation, the preferred SNR threshold is 100. If the SNR value is less than 100 for an extended interval, the signal is deemed to be unintelligible. The preferred SFM threshold is 0.1.

Noise Suppression

After the signal quality has been determined using the above described techniques, it may be desirable to enhance the speech signal or suppress the noise. As shown in FIG. 2, if the speech message is completely masked by noise, no attempt is made to improve the quality of the recorded signal. If, however, the signal is corrupted to an annoying level but is still intelligible, one of the following noise suppression techniques is applied to the signal so that the processed speech is more acceptable to the user.

The preferred suppression techniques implemented in the prototype assume the following model for the recorded speech signal:

$$x_i = s_i + n_i$$

where $x_i$ is the recorded signal, $s_i$ is the speech component and $n_i$ is the noise component.

Given the above model, the noise suppression can be achieved in time domain leading to time-domain solutions or in the spectral domain leading to spectral-domain solutions.

Figure 8A:
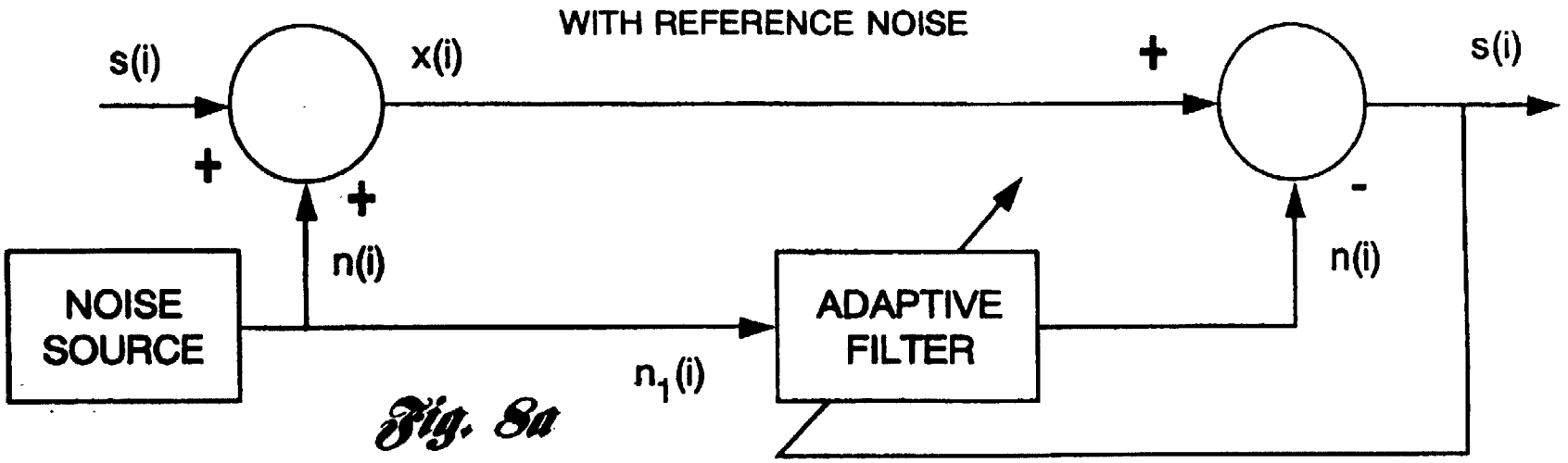
FIG. 8*a* is a flow chart illustrating the time domain solution for noise suppression with reference noise.
Figure 8B:
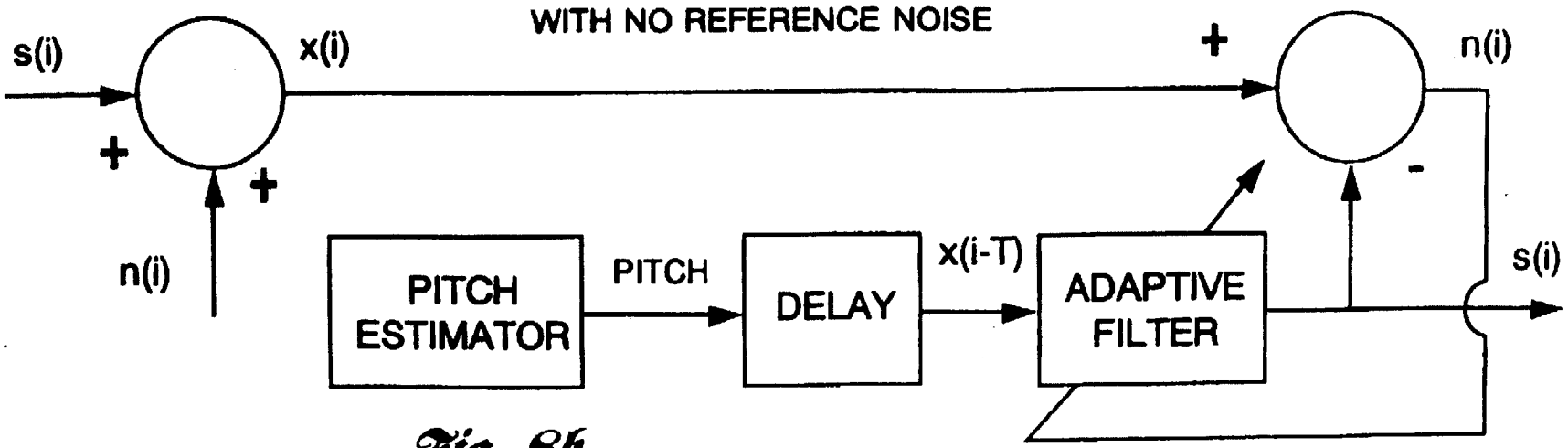
FIG. 8*b* is a flow chart illustrating the time domain solution for noise suppression without reference noise.

Referring now to FIG. 8, illustrating the time-domain solution, the noise/speech component is estimated such that the mean square error between the desired signal and the estimated signal is minimized. Various techniques such as Least Mean Square (LMS) estimation, Recursive Least Square (RLS) estimation may be employed to provide a time-domain solution. Other techniques, such as the Signal Subspace Method which is based on the projection of signal onto the space covered by eigenvectors corresponding to dominant eigenvalues, may also be employed.

Figure 9:
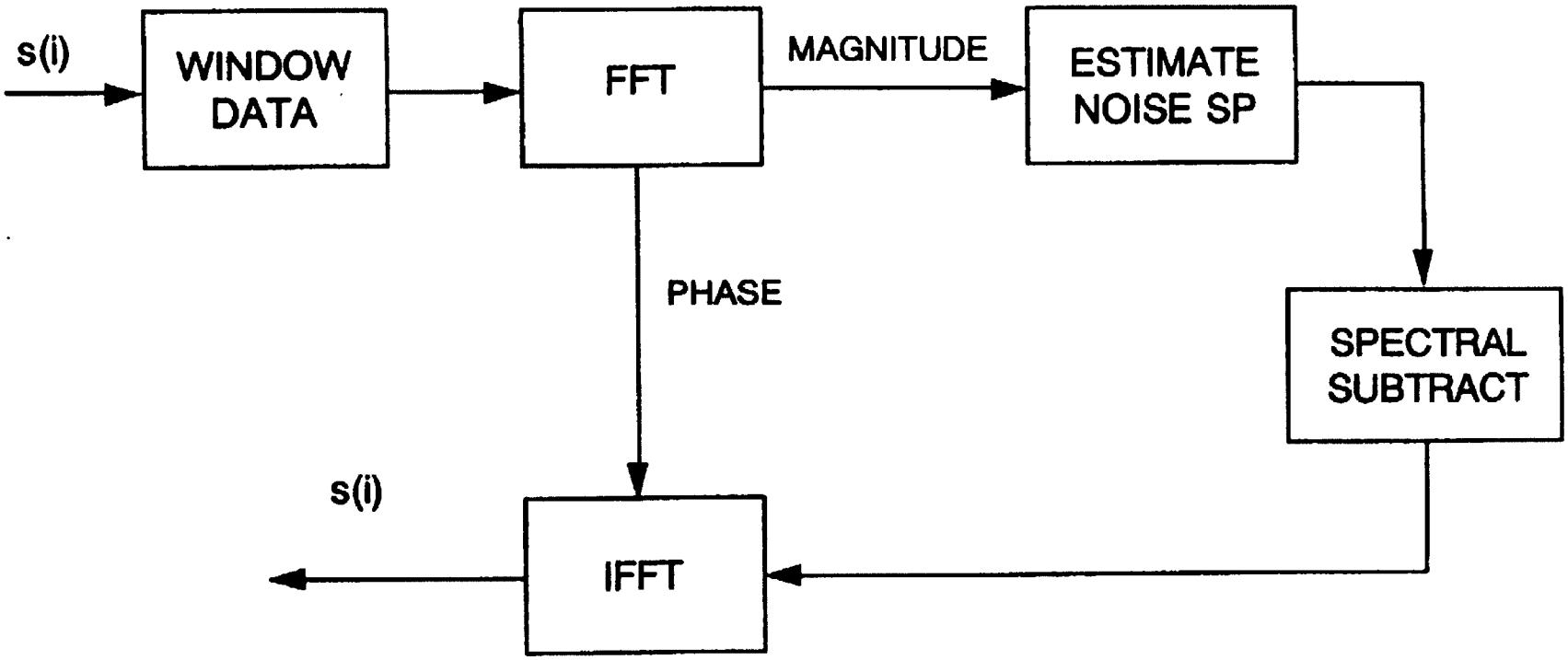
FIG. 9 is a flow chart illustrating the spectral domain solution for noise suppression.

Referring now to FIG. 9, there is illustrated the spectral-domain solution. The principle behind the Spectral-domain solutions is the estimation of magnitude of noise spectrum and subtract the noise spectrum from the magnitude of spectrum of the recorded signal to yield an estimate of clean speech spectrum:

$$|\hat{S}(\omega)|^2 |X(\omega)|^2 - \hat{N}(\omega)|^2$$

where $|\hat{S}(\omega)|^2$ is the estimated speech spectrum, $|X(\omega)|^2$ is the magnitude spectrum of the recorded signal and $|\hat{N}(\omega)|^2$ is the estimated noise spectrum.

The specific implementations of the speech spectrum estimation, namely modified spectral subtraction, RASTA filtering and Neural Network based RASTA (NN-RASTA) are employed by the preferred embodiment of the present invention. In the NN-RASTA method the linear RASTA mapping is replaced by non-linear NN mapping.

While the best mode for carrying out the invention has been described in detail, those familiar with the art to which this invention relates will recognize various alternative designs and embodiments for practicing the invention as defined by the following claims.

What is claimed is:

1. A method for determining if speech signals received by a voice messaging system from a caller are corrupted, the method comprising:

receiving a message signal representing an audio message from a caller;

determining a signal quality of the message signal;

comparing the signal quality to a threshold to determine whether the message signal is intelligible;

storing audio data representing the message signal if the signal quality is at least as great as the threshold thereby indicating that the message signal is intelligible; and transmitting an indication signal to the caller indicating that the signal quality is poor if the signal quality is not as great as the threshold.

2. The method of claim 1 wherein determining a signal quality includes:

identifying a speech component of the message signal;

identifying a noise component of the message signal; and calculating an instantaneous SNR based on the speech component and the noise component.

3. The method of claim 1 wherein determining a signal quality includes calculating a modified spectral flatness measure of the message signal.

4. The method of claim 1 wherein determining a signal quality includes calculating a moment for the message signal.

5. The method of claim 1 wherein the indication signal represents a recorded audio message indicating poor signal quality.

6. The method of claim 1 wherein receiving a message signal comprises receiving a message signal from a cellular telephone caller.

7. The method of claim 1 wherein receiving a message signal comprises receiving a message signal from a cordless telephone caller.

8. A method for identifying corrupted speech signals stored in a voice messaging system operating in a message retrieval mode, the method comprising:

receiving a signal representing a request from a caller to retrieve an audio message stored in the voice messaging system;

determining if the stored audio message is noisy;

transmitting a signal representing the stored audio message to the caller if the stored audio message is not noisy;

if the stored audio message is noisy, determining if the stored audio message is intelligible;

transmitting a signal to the caller indicating that the stored audio message is unintelligible if the stored audio message is unintelligible;

if the stored audio message is intelligible and noisy, processing stored audio data representing the stored audio message to obtain enhanced audio data representing an enhanced audio message; and transmitting a signal to the caller representing the enhanced audio message.

9. A system for determining if speech signals received by a voice messaging system from a caller are corrupted, the system comprising:

a receiver for receiving a message signal representing an audio message from a caller;

a processor for determining a signal quality of the message signal;

a comparator for comparing the signal quality to a threshold to determine whether the message signal is intelligible;

a memory for storing audio data representing the message signal if the signal quality is at least as great as the threshold thereby indicating that the message signal is intelligible; and a transmitter for transmitting an indication signal to the caller indicating that the signal quality is poor if the signal quality is not as great as the threshold.

10. The system of claim 9 wherein the processor determines the signal quality by identifying a speech component and a noise component of the message signal and calculating an instantaneous SNR based on the speech component and the noise component.

11. The system of claim 9 wherein the processor determines the signal quality by calculating a modified spectral flatness measure of the message signal.

12. The system of claim 9 wherein the processor determines the signal quality by calculating a moment for the message signal.

13. The system of claim 9 wherein the indication signal represents a recorded audio message indicating poor signal quality.

14. A system for identifying corrupted speech signals stored in a voice messaging system operating in a message retrieval mode, the system comprising:

a receiver for receiving a signal from a caller representing a request to retrieve a stored audio message;

a pre-processing component for determining if the stored audio message is noisy;

a transmitter for transmitting a signal representing the stored audio message to the caller if the stored audio message is not noisy;

if the stored audio message is noisy, said pre-processing component being further operable to determine if the stored audio message is intelligible, wherein said transmitter transmits a signal to the caller indicating that the stored audio message is unintelligible if the pre-processing component determines that the stored audio message is unintelligible; and a post-processing component for processing stored audio data representing the stored audio message to obtain enhanced audio data representing an enhanced audio message if the stored audio message is intelligible and noisy, wherein said transmitter transmits a signal to the caller representing the enhanced audio message.

* * * * *